United States Patent [19]

Brotz

[11] Patent Number: 4,579,632

[45] Date of Patent: Apr. 1, 1986

[54] ELECTRO-FORMED STRUCTURES

[76] Inventor: Gregory R. Brotz, P.O. Box 1322, Sheboygan, Wis. 53081

[21] Appl. No.: 738,401

[22] Filed: May 28, 1985

[51] Int. Cl.[4] ..... C25D 1/02; C25D 1/08; C25D 1/20

[52] U.S. Cl. ..... 204/9; 204/11

[58] Field of Search ..... 204/11, 23, 24, 25, 204/29, 30, 9

[56] References Cited

U.S. PATENT DOCUMENTS 3,287,169 11/1966 Rogers ..... 204/11
3,445,348 5/1969 Aske ..... 204/9
3,464,898 9/1969 Norris ..... 204/9
3,520,357 7/1970 Bruner ..... 204/9
3,549,505 12/1970 Hanusa ..... 204/11
3,694,325 9/1972 Katz ..... 204/11

*Primary Examiner*—T. M. Tufariello
*Attorney, Agent, or Firm*—William Nitkin

[57] ABSTRACT

A system of electro-forming by creating the shape to be electro-formed of a polystyrene or other material. The formed shape is then coated with a carbonizable resin and then carbonized, vaporizing the internal form to create a shell which is then metal-plated to form the desired structure.

4 Claims, 6 Drawing Figures

ELECTRO-FORMED STRUCTURES

BACKGROUND OF THE INVENTION

1. Field of the Invention

The method and structure of this invention reside in the field of electro-formed plated structures and more particularly relate to the creation of hollow metal structures.

2. Description of the Prior Art

The prior art in this field includes well-known methods of forming wax moldings of desired structures to which a conductive paint is applied and then electroplated. The wax is then melted out of the structure leaving the metallic plating to form the structure itself. If an iron plating bath is utilized which operates at a very high temperature, the wax form has been known to prematurely deform due to the heat.

SUMMARY OF THE INVENTION

It is an object of this invention to provide a new method for the creation of metallic electro-formed structures which avoid the heat sensitivities of the prior art wax moldings and to provide methods for continuous production of such structures. In one of its simplest embodiments, the structure of this invention is created by creating a shape in the form of the object to be made out of a polystyrene or equivalent material and coating that polystyrene with a carbonizable resin. The structure is heated in a carbonizing furnace which melts the interior polystyrene away and carbonizes the resin coating into a thin carbon structure. This carbon structure is then electroplated forming the desired metallic structure. The formation of such structure can occur on a continuous basis such as with a belt molder producing, for example, a polystyrene honeycomb structure. This particular structure is discussed herein only for purposes of illustration, and it should be noted that any shape of structure in which the polystyrene or equivalent material can be formed is utilizable in this invention.

DESCRIPTION OF THE PREFERRED EMBODIMENT(S)

Figure 1:
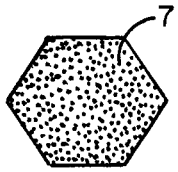
FIG. 1 illustrates a shape of an object formed in polystyrene.
Figure 2:
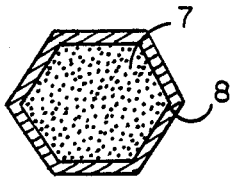
FIG. 2 illustrates the polystyrene shape of FIG. 1 coated with a carbonizable resin.
Figure 3:
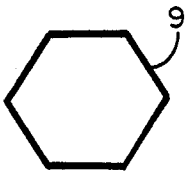
FIG. 3 illustrates the structure of FIG. 2 after baking and vaporizing the polystyrene thereout and after carbonization of the resin coating.
Figure 4:
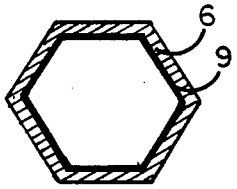
FIG. 4 illustrates the electroplating deposited on the carbon substrate forming the finished structure.

FIG. 1 illustrates a cross-sectional view of material 7 whose exterior shape is in the form of the final structure to be created. A type of material that can be utilized for this shape is expanded polystyrene or other inexpensive non-carbonizing material whose volume is comprised mostly of air. Other types of materials can be used as described below. The structure of FIG. 1 is then coated with a carbonizable-type resin coating 8 as seen in FIG. 2. In FIG. 3 the same structure is shown after it has been fired in a carbonizing furnace and the interior polystyrene has vaporized due to heat. The resin has carbonized becoming hard shell 9 on which electroplating 6 is deposited as seen in FIG. 4. Electroplating can be deposited on the carbon because the carbon is electrically conductive. Other equivalent plating processes can be utilized.

Figure 5:
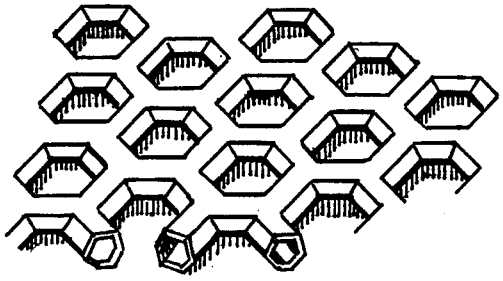
FIG. 5 illustrates a typical structure that could be produced by continuous belt moldings of a honeycomb-type structure showing the carbon substrate covered by electroplating.

FIG. 5 illustrates a typical structure that could be produced by the method of this invention formed in a honeycomb grid with carbon substrate 9 coated by electroplating 6. It should be noted that the shape of the structure is not limited by the example illustrated and that any shape in which the polystyrene could be formed would be suitable for use according to the invention disclosed herein.

Figure 6:
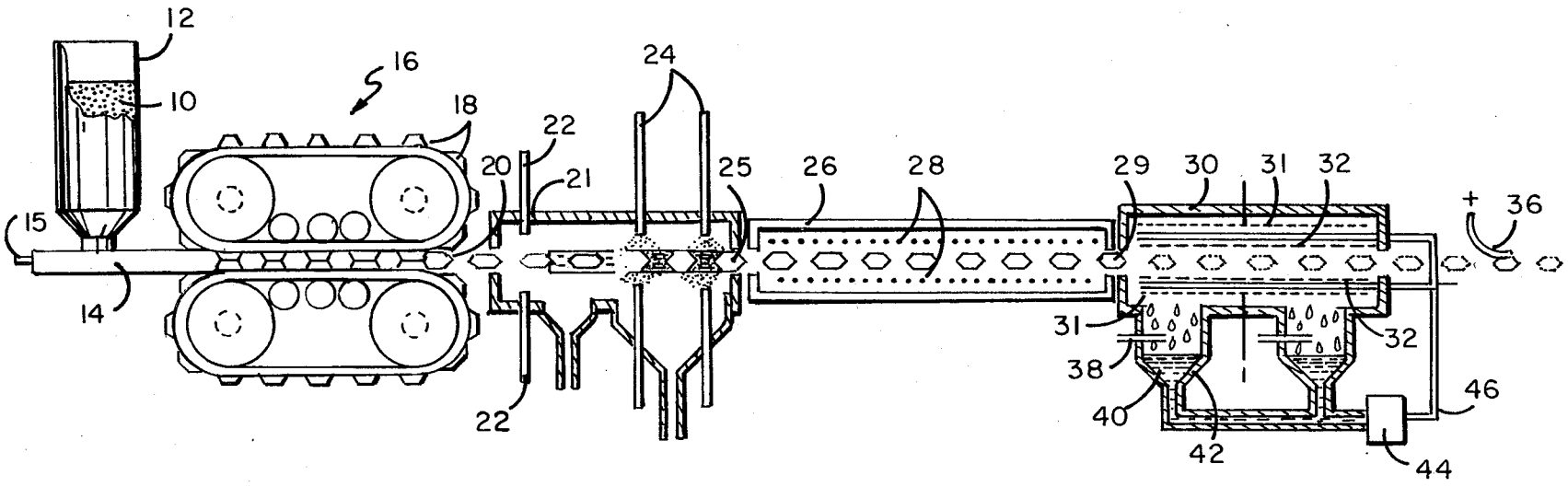
FIG. 6 illustrates a production line for the continuous production of a structure such as seen in FIG. 5.

A method for producing a continuous production of such electro-formed product is seen in FIG. 6. In FIG. 6 polystyrene beads 10 are initially held within container 12, then drop into delivery tube 14 and are blown by steam from pipe 15 into continuous belt molder 16 which has a plurality of molding blocks 18 which impart a shape to the polystyrene beads as they pass therethrough molding them into the desired shape. One such shape could be the structure as shown in FIG. 5 although any mold could be utilized to produce such polystyrene beads into the desired form. The positive parts of the continuous mold become the negative parts of the formed structure. Due to the heated steam and/or heated belt rollers, the polystyrene beads expand within continuous molding belt 16 and as they move along, they expand to form polystyrene shape 20 coming out at the end of the belts. The belts also can be heated to help the polystyrene expand into the desired shape. The molded polystyrene substrate 20 then leaves molding machine 16 and enters coating chamber 21 where first spray 22 coats polystyrene substrate 20 with a carbonizable resin in a solution such as an organic solvent or water. In some embodiments it may be desirable to have a thicker coating applied. Within coating chamber 21 additional spray(s) 24 can deposit a particulate or granular resin on coated substrate 20 which adheres to the coating that had previously been sprayed on the substrate. The particulate resin can be an uncured phenolic resin or equivalent thereof. In some embodiments it may be desirable to have more resin solution/resin particulate combination sprays within coating chamber 21 and further resin solutions and resin particulates can be sprayed on the substrate to build up an even thicker layer of resin if such is desired in the final product depending on the structural needs of the desired shape to be formed. Carbonizable resin-coated substrate 25 then enters carbonizing furnace 26 in which the temperature rises as resin-coated substrate 25 continues along the production line and passes between heating coils 28. The solvent in the resin solution is first driven off as the temperature rises, and the resin particulates fuse together to form a continuous layer around the polystyrene substrate. As the temperature rises still higher, the curing temperature of the resin is reached and the resin cures, forming an infusable resin coating. At about the curing temperature, the polystyrene core melts and forms a shallow pool at the bottom of the cured resin structure. As the temperature rises higher, the remaining resin structure carbonizes which carbonization can be accomplished at a fast rate because of the thin walls of the structure. Fracturing due to moisture and products of carbonization escaping from the interior of the then hollow structure would be minor. Much of the byproduct gases produced during firing escape through the interior of the structure and exit through the openings caused by the cut-off saw down the line.

Once carbon structure 29 leaves carbonizing furnace 26, it passes into plating chamber 30 where it is plated to a desired thickness. In the plating chamber the metallic coating is plated on the carbon structure. Plating chamber 30 can contain a noble gas so that electrical continuity can be maintained between the electroplating solution and electrode grid 31 which is located inside chamber 30. The spray of electroplating can emanate from spray nozzle 32 inside electrode grids 31 and be directed both downward and upwards onto the carbon structure. Electrode grid 31 can be disposed both above and below the electoplating spray nozzles and due to the gas therein, electrical continuity is formed between the structure being plated and the electroplating spray. Excess spray 40 which drops out of the chamber can be collected within collection areas 42 and be pumped by pump 44 through lines 46 back into spray nozzles 32 to be resprayed onto the structure. The other electrode, being anode 36, can make contact with the metallic-coated structure after being plated as it proceeds out of plating chamber 30 and this contact will complete the circuit between the cathode and anode creating the electric current necessary for the plating to occur. Conductive gas inlet 38 allows gas to be introduced into the plating chamber. The gas must be ionized to be conductive and one gas that would be suitable is helium.

It should also be noted that since carbon has a very high melting point, that dip coating the carbon structure into a molten metal bath is possible. Also, because the carbon is conductive, electron plasma sputtering is another coating process that can be used. A coolant can be run through the interior of hollow forms to cause the sputtered material to condense more readily.

Another type of material that can be used for the interior form is a carbonizable foam such as a phenolic foam. The phenolic foam will shrink at approximately the same rate and to the same dimensions as the carbonizing shell. The usage of a carbonizable foam is advantageous in continuous production processes as it affords a stronger support than polystyrene as it passes through the various processing stations. It is also possible to use a reticulated polyurethane foam that has been saturated with a carbonizable resin for an interior form. Any excess resin can be removed from the foam before passing it into the resin coating chamber.

The particulate material applied over the resin in the coating of the interior form can, in a further embodiment, contain graphite. Mixing graphite-filled particulate with the resin has the benefit of making the carbonizing cycle shorter than if pure resins are used as it avoids the glassy phase in the processing of pure resins which makes the structure nonporous. As the byproducts of carbonization are produced, these byproducts which have to escape from the interior of any nonporous wall section will cause the structure to rupture. When graphite which has a porous nature in most commercial-grade powders is added, the byproducts can escape through the micropores in the graphite. Glassy carbon is formed in the zones between the graphite particles. The glassy carbon is the binder for the graphite which is very soft. The amount of graphite which is added should not be so great as to stop the particles from flowing together during the heating cycle. Too great an amount of graphite will cause the material to be too stiff. The amount of graphite loading is dependent upon the viscosity of the melted binder resin.

Another example of coating the interior form is to spray a solution of phenolic resin in an organic solvent that has been highly filled with graphite (up to 60% by weight) onto a precarbonized foam interior form that is being heated dielectrically. As the spray hits the hot substrate, the organic solvent is immediately driven off leaving the resin and graphite to fuse uniformly. The porosity of the graphite should not allow the plating bath to be adsorbed.

Although the present invention has been described with reference to particular embodiments, it will be apparent to those skilled in the art that variations and modifications can be substituted therefor without departing from the principles and spirit of the invention.

I claim:

1. An improved electro-forming process for a plating to form a structure, comprising:

forming a molding of expanded polystyrene;
coating said molding with a carbonizable resin;
carbonizing said resin;
vaporizing said polystyrene; and
plating said carbon to form a structure.

2. The process of claim 1 wherein said process is continuous and further includes the steps of:

entering polystyrene beads into a continous molding belt;
heating said beads in order to expand them;
molding said beads into a shape;
coating said formed polystyrene shape with a carbonizable resin spray solution;
depositing resin particulate thereon;
entering said structure into a carbonizing furnace;
heating said structure at increasing levels of temperature;
driving the solvents out of said resin;
curing said resin by said increasing temperature;
carbonizing said resin by said heating;
melting said shaped beads;
entering said resulting carbon structure into a plating chamber;
entering electro-plating spray into said chamber;
coating said structure with said electro-plating spray; and
passing electric current through said structure and said electro-plating spray.

3. The method of claim 2 further including the step of entering a noble gas within said plating chamber.

4. The method of claim 1 wherein said expanded polystyrene is replaced by a carbonizable foam material.

* * * * *